United States Patent [19]

Rydberg

[11] 4,023,284

[45] May 17, 1977

[54] ANTI-SLIP DEVICE FOR FOOTWARE

[76] Inventor: Sverker Rydberg, Nackebo gard, 590 20 Mantorp, Sweden

[22] Filed: Apr. 2, 1975

[21] Appl. No.: 564,382

[30] Foreign Application Priority Data

Sept. 25, 1974 Sweden ..... 7412023

[52] U.S. Cl. ..... 36/59 R

[51] Int. Cl.[2] ..... A43B 23/28

[58] Field of Search ..... 36/59 R, 59 A, 67 A

[56] References Cited

UNITED STATES PATENTS

| | | | |
|---|---|---|---|
| 1,165,235 | 12/1915 | Emery | 36/59 A |
| 2,303,744 | 12/1942 | Jacobs | 36/59 A |

FOREIGN PATENTS OR APPLICATIONS

| | | | |
|---|---|---|---|
| 874,011 | 7/1942 | France | 36/67 A |

*Primary Examiner*—Patrick D. Lawson

*Attorney, Agent, or Firm*—Lowe, King, Price & Markva

[57] ABSTRACT

An Anti-Slip device for footwear, walking sticks and the like, comprises a heel member, a ground-engaging protrusion composed of relatively soft material depending downwardly beneath said heel member, a resiliently flexible flange or membrane of ring form interconnecting said heel member and said protrusion, and a gripping ring composed of relatively hard material disposed on said protrusion. The heel member has a hollow recess above said flexible flange or membrane, and the arrangement is such that so long as no slipping occurs the gripping ring remains in spaced relationship with the ground out of contact therewith but as soon as slipping commences the ground-engaging protrusion pivots sideways by flexing of the flexible flange or membrane and causes a lower edge portion of the gripping ring to be thrust into contact with the ground so as to restrain the slipping.

33 Claims, 10 Drawing Figures

ANTI-SLIP DEVICE FOR FOOTWARE

BACKGROUND OF THE INVENTION

To prevent slipping of footwear, one has, up to now, used fixed studs or loose spikes on a heel or sole which are fastened to a shoe with straps or by a rubber case around the front part of the foot and a rubber strap behind the heel.

These devices give good protection against slipping on ice and packed snow. The fixed studs, however, badly damage parquet floors or linoleum floor coverings and the loose spikes are difficult to put on and take off.

PURPOSE OF THE INVENTION

An object of the present invention is to provide an anti-slip device fixed or embodied in a specially designed heel or sole which does not bring about any damage to parquet floors or linoleum floor coverings and which is fully efficient on ice, packed snow and wet metal roofs and rocks.

SUMMARY OF THE INVENTION

This objective, and other advantages, are obtained through the use of the antislip device as disclosed herein. The device is useful for preventing slipping on a walking surface. The device comprises a base portion and a protrusion portion that is connected to the base portion to cause the protrusion portion to move between a first position and a second position with respect to the base portion. The protrusion portion has a gripping surface section and a non-gripping surface section. The nongripping surface section is in contact with the walking surface when the protrusion portion is in the first position. The gripping surface section is in contact with the walking surface when the protrusion portion is in the second position. The base portion and protrusion portion are connected by a connecting means having a structural configuration effective to maintain the protrusion portion in the first position when the walking surface is not slippery but is effective to cause the protrusion portion to be in the second position when the walking surface is slippery. Thus, when the surface is not slippery, the gripping surface section is not in contact with the walking surface thus protecting the walking surface from any damage. When the walking surface is slippery such as on an icy ground condition, the gripping surface section of the protrusion will be in contact with the slippery walking surface.

There are various embodiments of the protrusion portion having different shapes on the end thereof wherein the nongripping surface section is located. There are also various embodiments of the gripping surface section which are laterally displaced with respect to the nongripping surface section of the protrusion portion. As is evident from the disclosure, the antislip device may include a single base portion and protrusion portion interconnected as stated or it may comprise a plurality of elements having the stated relationship existing between the protrusion portion and base portion. A plurality of these elements would be placed across the entire surface of an article of manufacture such as a shoe sole or heel.

BRIEF DESCRIPTION OF DRAWINGS

Other objects of this invention will appear in the following description and appended claims, reference being made to the accompanying drawings forming a part of the specification wherein like reference characters designate corresponding parts in the several views.

DESCRIPTION OF SPECIFIC EMBODIMENTS

More specifically, each of the designs showing various embodiments of an antislip device made in accordance with this invention, are discussed with respect to the vertical, longitudinal sectional view of heels having the antislip device attached thereto.

Figure 1:
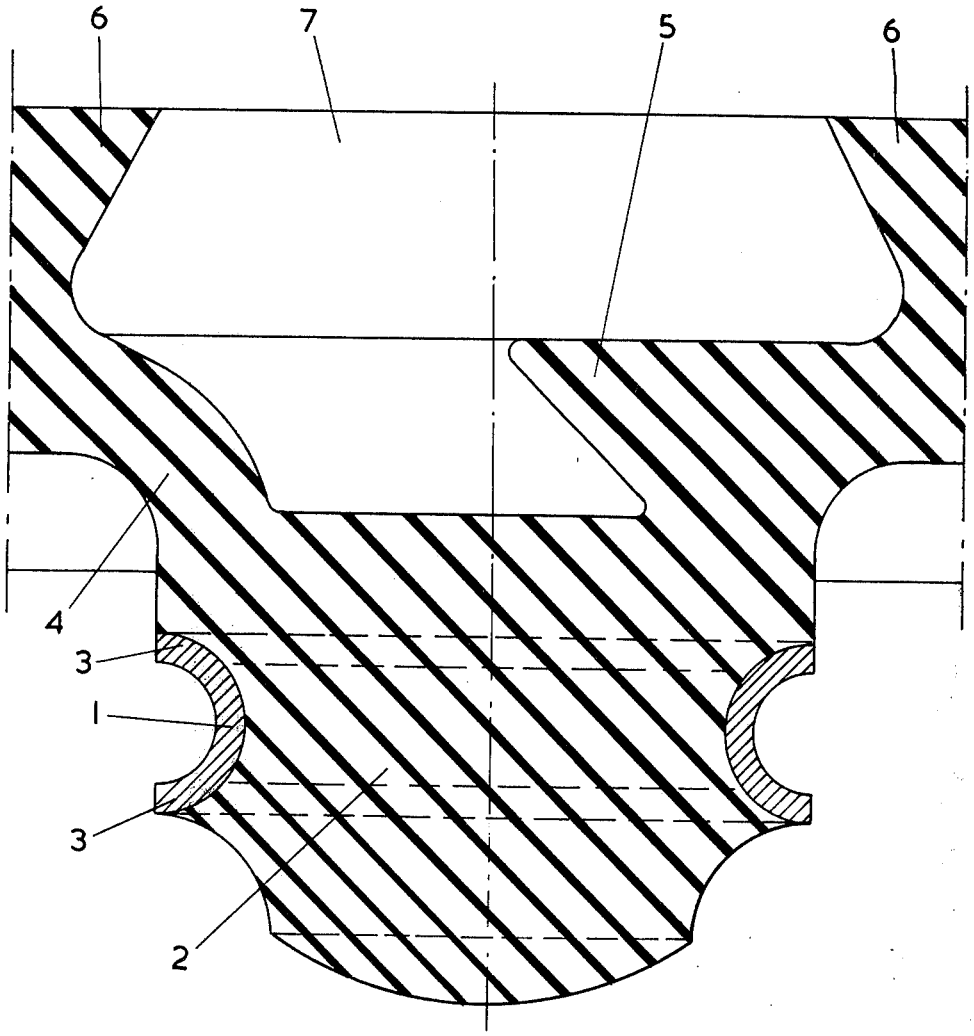
FIG. 1 is a longitudinal cross-sectional view of an antislip device made in accordance with this invention.

Design I (FIG. 1)

On a substantially cylindrical rubber extrusion or protrusion 2 there is a ring 1 made of hard metal coaxially bonded or vulcanized to it. The ring 1 is semi-circular in radial cross section, so shaped that its concave surface is presented outwards. The extrusion 2 projects under the ring 1 and is finished off with a convex surface on its underside. Its upper end is connected, by means of an upwards diverging flange ring 4 of rubber, with a heel or sole 6, also of rubber, which is provided with a groove or recess 7 above the center of the extrusion 2 and this groove 7 is preferably shaped mainly as an upwards converging truncated cone.

The flange ring 4 is thinner on that side upon which one would wish that the extrusion 2 should most easily bend or pivot and is on its opposite side provided with extensions 5 presented towards the groove 7, so arranged as to limit the pivoting angle and to direct and facilitate the pivoting of the extrusion 2 in the appropriate direction.

The deivce works as follows. During normal walking, the extrusion 2 will be pressed upwards without any special turning or pivoting action, whereby its convex underside is lying against the ground. Because of the fact that this underside consists of rubber, it cannot damage floors. If, while walking on slippery ground, the shoe should start slipping, the extrusion 2 will turn or bend in the opposite direction against the slippage so that the outwards pointing edges of the ring 1 will sharply drive into the ground and thereby stop the slipping.

It has proved advantageous to incorporate, in the underside of the extrusion 2, pieces of hard material which, during slipping, will increase the friction of the extrusion 2 against the ground and initiate the pivoting or bending of the extrusion 2.

Figure 2:
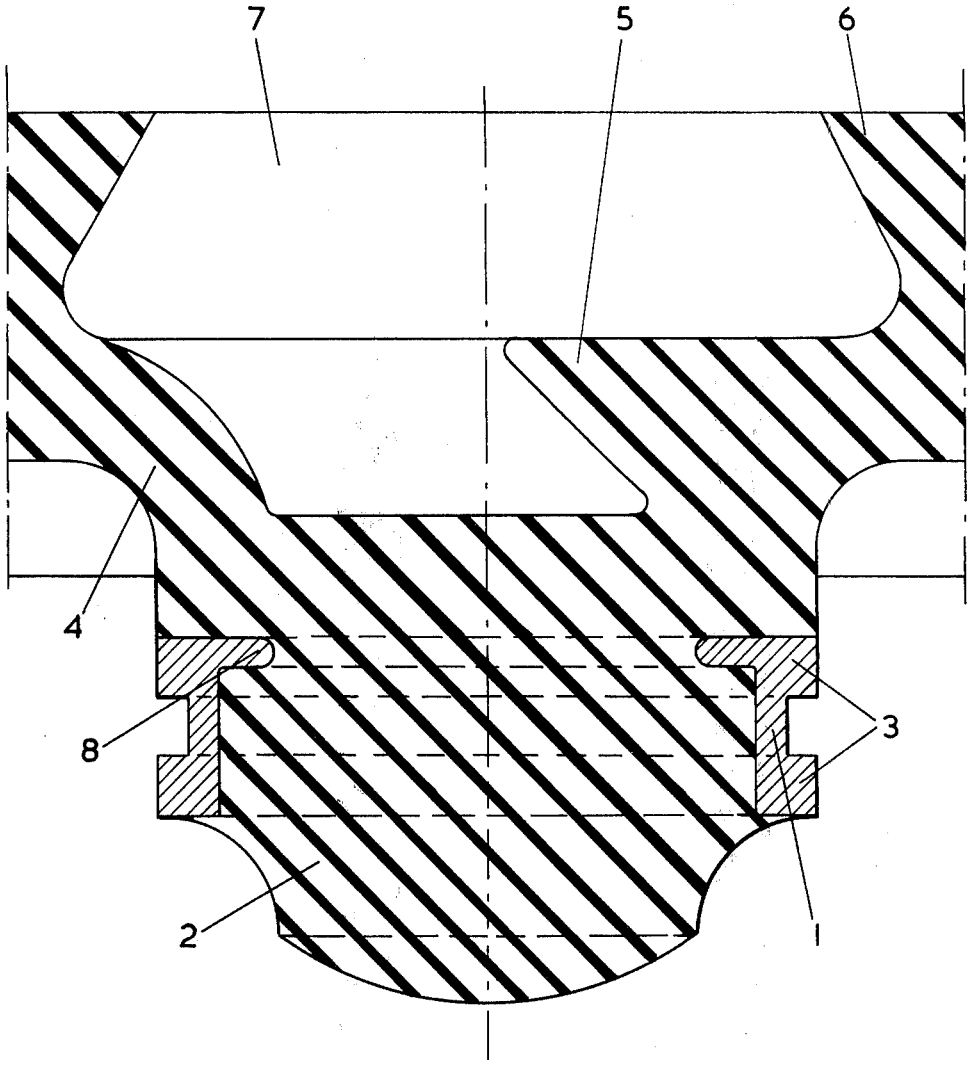
FIG. 2 is a further embodiment of an antislip device made in accordance with this invention.

Design II (FIG. 2)

This design differs from the above mentioned design of FIG. 1 in the respect that the ring 1 in radial cross section is shaped like a cylinder with outwardly directed end flanges 3. It has also proved advantageous to provide the ring 1 with an inwards pointing flange 8 in the upper end of the ring 1.

This design works in the same way as design I.

Figure 3:
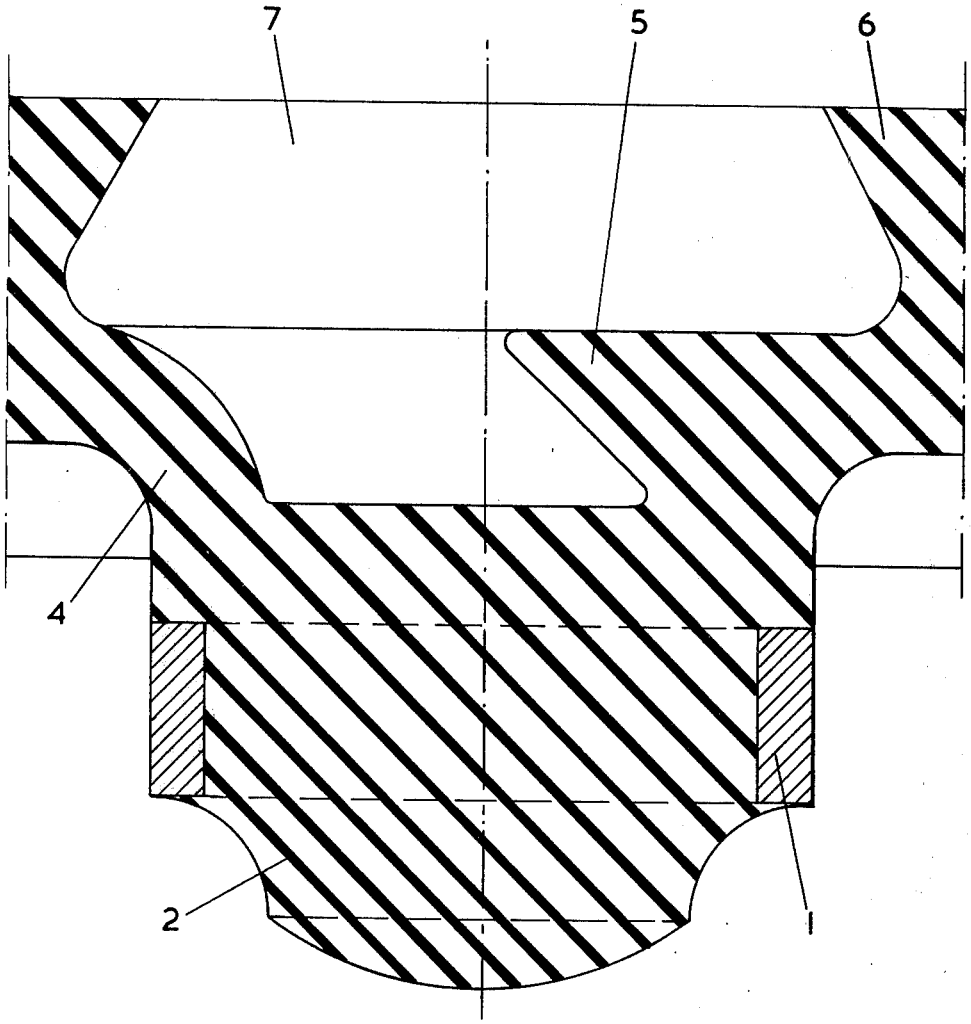
FIG. 3 is a longitudinal cross-sectional view of a further embodiment of an antislip device made in accordance with this invention.
Figure 4:
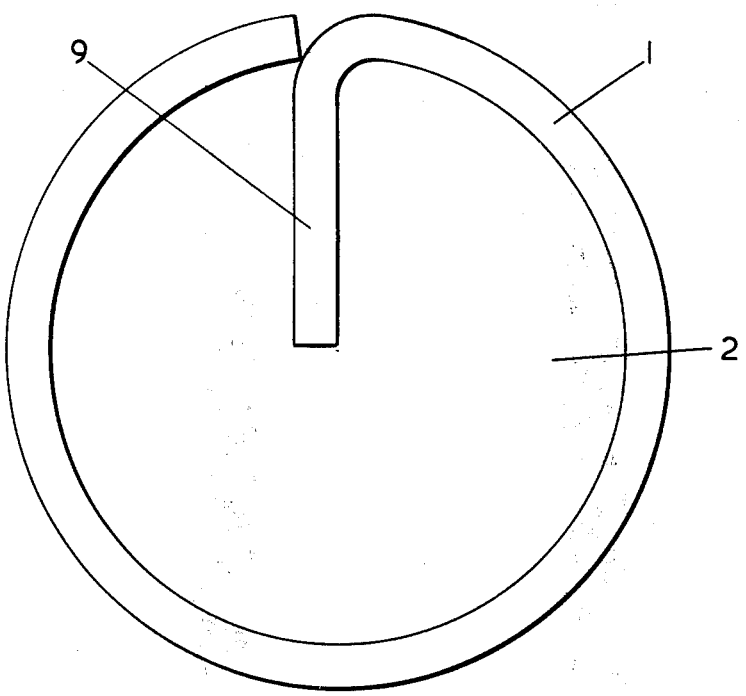
FIG. 4 is a top-plan view of a gripping ring element as used in the embodiment as shown in FIG. 3.

Design III (FIG. 3 and 4)

This design differs from the above mentioned design in the respect that the ring 1, which lacks flanges, is made of a strip that has been bent into a ring. In order to improve the bonding or vulcanization it has proved advantageous to bend at least one end 9 of the strip inwards towards the center of the ring as shown in FIG. 4.

Figure 5:
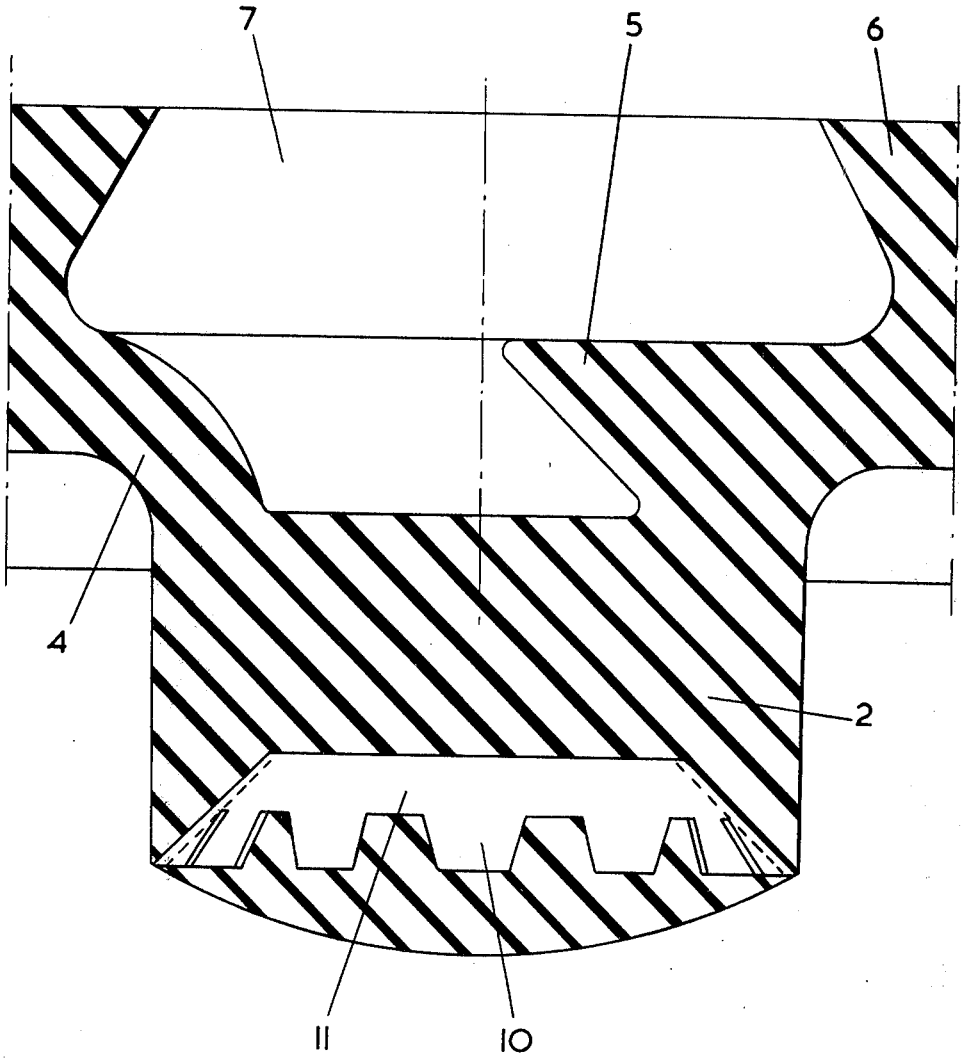
FIG. 5 is a longitudinal cross-section of a further embodiment of an antislip device made in accordance with this invention.

Design IV (FIG. 5)

This design differs from the above mentioned design in the respect that the ring 1 has been replaced by a vulcanized or bonded conical plate 11 with a hole centrally throughout and with outwards pointing teeth 10 which preferably reach the lower outside end of the extrusion 2.

Because of the cost, it has proved advantageous to make the greater part of the rings 1 or of the plates 11 in normal hard metal and only the lower edge of the rings 1 and the teeth of the plates 11 in hardened metal.

This design of FIG. 5 also works substantially in the same way as design I.

Figure 6:
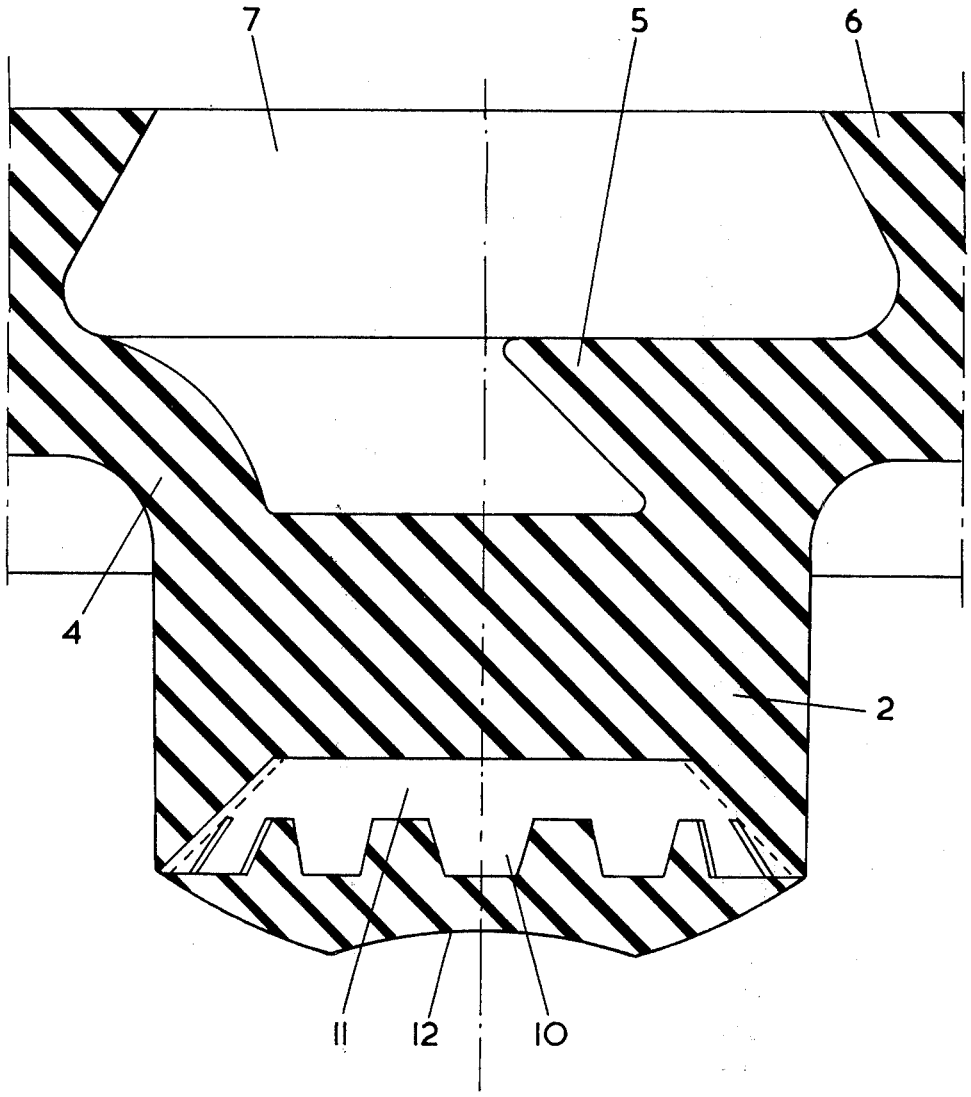
FIG. 6 is a longitudinal cross-sectional view of a still further embodiment of an antislip device made in accordance with this invention.

Design V (FIG. 6)

This design differs from design IV in the respect that the extrusion 2 on its convex underside is provided with a central spherical concave groove or recess 12, which, while walking, particularly on wet glassy ice, works as a suction cup and when slipping contributes to initiating the pivoting. The diameter of the groove 12 is preferably half that of the outside diameter of the plate 11.

Figure 7A:
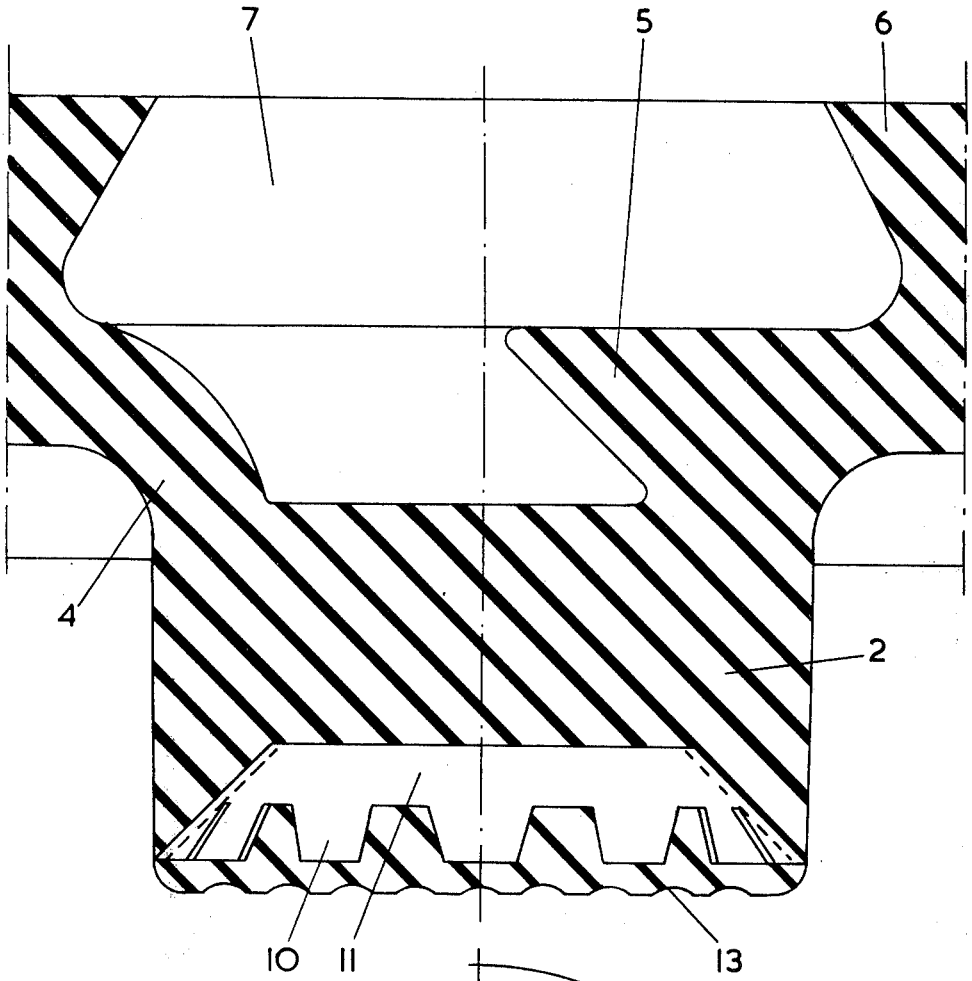
FIG. 7*a* is a longitudinal cross-sectional view of another embodiment of an antislip device made in accordance with this invention.
Figure 7B:
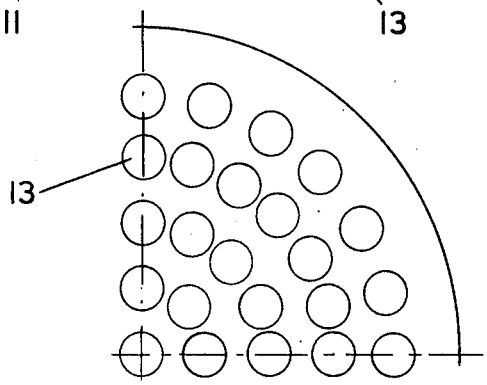
FIG. 7*b* is a fragmentary plan view of the embodiment shown in FIG. 7*a;*

Design VI (FIG. 7)

This design differs from design V in the respect that the projecting part of the extrusion 2 under the plate 11 is provided with a substantially flat underside in which there are arranged a number of spherically curved concave grooves or recesses 13 of shallow depth, preferably arranged in concentrical rings, which work as suction cups when walking on wet glassy ice and initiate the pivoting when slipping.

Figures 8, 9:
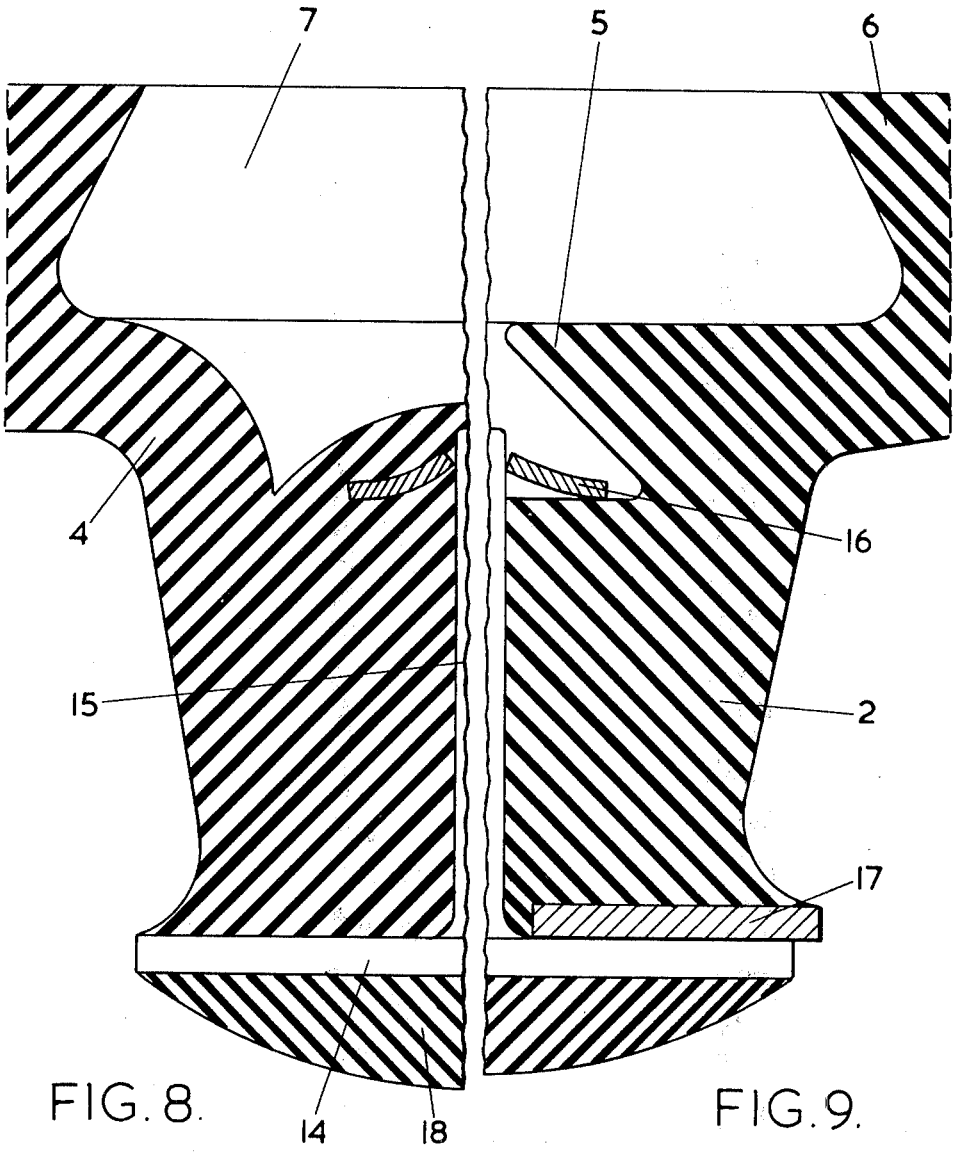
FIG. 8 is a fragmentary, longitudinal sectional view of another embodiment made in accordance with this invention.
FIG. 9 is a fragmentary, longitudinal cross-sectional view of a further embodiment made in accordance with this invention.

Design VII (FIG. 8)

This design differs from the above mentioned design in the respect that the extrusion 2 on its underside is provided with a circular plate 14 made of hard material which is at its upperside provided with a projecting central handle 15. This handle 15 extends through a central hole in the extrusion 2 and is kept fixed by a tab 16 bonded in the extrusion 2 near its upper side with resilient fingers which lie against the handle 15.

Design VIII (FIG. 9)

This design differs from design VII in the respect that the tab 16 is not bonded or vulcanized to the extrusion 2 but lies against the upper side of said extrusion 2, and that between the plate 14 and the underside of the extrusion 2 there is positioned a flange 17 made of hard metal of which the edge protrudes beyond the edge of the plate 14.

While here only eight designs are shown and described, others can exist within the scope or framework of this invention.

I claim:

1. An antislip device for preventing slipping on a walking surface, said device comprising:

a. a base portion and a protrusion portion, b. said protrusion portion having a gripping surface section and a nongripping surface section, and c. means connecting the protrusion portion to the base portion to cause the protrusion portion to move between a first position and a second position with respect to the base portion, d. said nongripping surface section being in contact with the walking surface when the protrusion portion is in the first position, e. said gripping surface section being in contact with the walking surface when the protrusion portion is in the second position, f. said connecting means having a structural configuration effective to maintain the protrusion portion in said first position when the walking surface is not slippery but effective to cause the protrusion portion to be in said second position when the walking surface is slippery.

2. A device as defined in claim 1 wherein said connecting means is resiliently flexible to cause the protrusion portion to move between said first and second positions.

3. A device as defined in claim 1 wherein said connecting means comprises a resiliently flexible ring-shaped membrane which causes the protrusion portion to pivot between said first and second positions.

4. A device as defined in claim 1 wherein said base portion has a structural configuration connectable to an article of manufacture used in walking across said walking surface.

5. A device as defined in claim 1 wherein said base portion includes a groove and is connectable to a heel, sole or ferrule of an article of manufacture used in walking across said walking surface.

6. A device as defined in claim 1 wherein said base portion comprises a heel, sole or ferrule.

7. A device as defined in claim 1 wherein said connecting means comprises a resiliently flexible ring-shaped membrane that is thinner on one side than on the other side thereof to cause the protrusion portion to bend along said thinner side between the first and second positions.

8. A device as defined in claim 1 wherein said connecting means comprises a resiliently flexible ring-shaped membrane having an inwardly directed extension on one side thereof to cause the protrusion portion to bend along the side of the membrane opposite said extension.

9. A device as defined in claim 8 wherein said inwardly directed extension has a substantially triangular cross-section in the plane of the longitudinal axis of the device to limit the angle of bending and to facilitate bending in the desired direction.

10. A device as defined in claim 1 wherein said protrusion gripping surface section includes a gripping element composed of hard material.

11. A device as defined in claim 10 wherein said protrusion has a circular cross-section normal to the longitudinal axis of the device, and said gripping element comprises a circular gripping ring disposed around the protrusion.

12. A device as defined in claim 10 wherein said gripping element comprises a gripping ring made of a strip bent into the shape of a cylindrical ring.

13. A device as defined in claim 12 wherein at least one of the strip's ends is bent inwardly toward the center of the ring.

14. A device as defined in claim 10 wherein said gripping element comprises a gripping ring having a radially, outwardly pointing flange at least at the lower axial end thereof, said flange having an outer edge being located along the outside of the protrusion portion.

15. A device as defined in claim 14 wherein the gripping ring has an inwardly directed flange ring at the upper axial end thereof.

16. A device as defined in claim 10 wherein said gripping element comprises a ring plate having downwardly pointing teeth in a central hole therethrough.

17. A device as defined in claim 16 wherein said ring plate teeth reach out to the lower outside end of the protrusion portion.

18. A device as defined in claim 10 wherein said gripping element comprises a gripping ring fixed to the protrusion portion and having a central piece which will protrude down beyond the lower edge of the gripping ring.

19. A device as defined in claim 18 wherein the outer end of the protrusion portion is substantially convex and has its periphery positioned at the same level as the lower edge of the gripping ring.

20. A device as defined in claim 19 wherein the outer end of the protrusion portion has a substantially spherical concave groove effective to work as a suction cup.

21. A device as defined in claim 18 wherein the outer end of the protrusion portion has an underside piece of hard material located under the lower edge of the gripping ring to drive into the ground when slipping begins for initiating the pivoting of the protrusion from the first position to the second position.

22. A device as defined in claim 21 wherein the outer end of the protrusion portion has a central, substantially flat part including a number of spherical concave grooves effective to work as suction cups.

23. A device as defined in claim 22 wherein the grooves are disposed in concentrical rings with respect to each other.

24. A device as defined in claim 10 wherein said gripping element is a ring-shaped plate having a perpendicularly, upwardly directed handle disposed at the center thereof, said handle extending through a vertical hole in the protrusion portion whereby the plate is kept seated against the flat underside of the extrusion portion with a shaft tab.

25. A device as defined in claim 24 wherein the shaft tab is fixedly bonded to the protrusion portion.

26. A device as defined in claim 24 wherein said plate seated against the flat underside of the protrusion portion has a comparatively small layer of rubberized elastic material on its underside.

27. A device as defined in claim 26 wherein said underside of the layer is shaped like a ball cap.

28. A device as defined in claim 26 wherein a flange of hard material is positioned between said plate and said underside of the protrusion portion.

29. A device as defined in claim 28 wherein the edge of the flange protrudes beyond the edge of the plate.

30. A device as defined in claim 1 wherein there are a plurality of devices each having a base portion connected to a protrusion portion.

31. A device as defined in claim 1 wherein the nongripping surface section is located at the end of the protrusion portion away from the base portion.

32. An antislip device for preventing slipping on a walking surface, said device comprising:

a. a heel member and a ground engaging protrusion depending downwardly beneath the heel member, b. a resiliently flexible ring-shaped membrane interconnecting said heel member and said protrusion, and c. a gripping ring composed of relatively hard material disposed on said protrusion, d. said heel member having a hollow recess above said flexible membrane, e. said protrusion extending outwardly in a first position to maintain the gripping ring in shaped relationship with respect to the walking surface when no slipping occurs, f. said membrane being flexed to cause the protrusion to pivot sideways with respect to said first position and the lower edge portion of the gripping ring to be thrust into contact with the walking surface so as to restrain slipping.

33. A device as defined in claim 32 wherein said protrusion is composed of relatively soft material.

* * * * *